US010687637B2

(12) United States Patent
Duijts et al.

(10) Patent No.: US 10,687,637 B2
(45) Date of Patent: Jun. 23, 2020

(54) PROMOTION DEVICE

(71) Applicant: ERD EASY B.V., Veenendaal (NL)

(72) Inventors: Hendrikus Dorotheus Duijts, Veenendaal (NL); Pedro Miguel Fernandes Dinis, Veenendaal (NL)

(73) Assignee: ERD EASY B.V., Veenedaal (NL)

( * ) Notice: Subject to any disclaimer, the term of this patent is extended or adjusted under 35 U.S.C. 154(b) by 0 days.

(21) Appl. No.: 16/068,866

(22) PCT Filed: Jan. 6, 2017

(86) PCT No.: PCT/EP2017/050282
§ 371 (c)(1),
(2) Date: Jul. 9, 2018

(87) PCT Pub. No.: WO2017/118743
PCT Pub. Date: Jul. 13, 2017

(65) Prior Publication Data

US 2019/0021520 A1 Jan. 24, 2019

(30) Foreign Application Priority Data

Jan. 8, 2016 (NL) ..... 2016076
Mar. 18, 2016 (NL) ..... 2016457

(51) Int. Cl.
*A47F 5/08* (2006.01)
*A47F 5/00* (2006.01)

(52) U.S. Cl.
CPC ..... *A47F 5/0853* (2013.01); *A47F 5/0006* (2013.01); *A47F 5/0823* (2013.01); *A47F 5/0869* (2013.01)

(58) Field of Classification Search
CPC .... A47F 5/0853; A47F 5/0006; A47F 5/0823; A47F 5/0869
USPC ..... 211/59.1, 59.2
See application file for complete search history.

(56) References Cited

U.S. PATENT DOCUMENTS 1,033,915 A * 7/1912 McDonald ..... B42F 13/12 211/57.1
3,912,084 A * 10/1975 Valiulis ..... A47F 5/0823 248/220.22
4,289,242 A * 9/1981 Kenyon ..... A47F 5/0861 211/4
4,394,909 A * 7/1983 Valiulis ..... A47F 5/0823 211/59.1

(Continued)

FOREIGN PATENT DOCUMENTS

DE 20012583 U1 2/2001
DE 202006017549 U1 3/2008
WO 9310516 A1 5/1993

*Primary Examiner* — Patrick D Hawn
(74) *Attorney, Agent, or Firm* — AEON Law, PLLC; Adam L. K. Philipp; David V. H. Cohen

(57) ABSTRACT

The invention provides a promotion device for communicating information regarding a product on display on a display system for retail and attached to a hook or rod that is part of a store fixture shelving system, a pegboard or slatwall system, or display system for retail, said device comprising a mounting part for attaching to a rod of said retail display system, an arm extending from said mounting part to an end of said rod, and a frame attached to an end of said arm and for said frame providing a cadre around the product.

17 Claims, 11 Drawing Sheets

(56) References Cited

U.S. PATENT DOCUMENTS 4,474,300 A * 10/1984 Entis ..... A47F 5/0861 211/4
4,525,944 A * 7/1985 Fast ..... G09F 1/04 40/584
4,583,308 A * 4/1986 Taub ..... A47F 5/0869 248/220.41
4,703,570 A * 11/1987 Fast ..... A47F 5/0869 40/642.01
4,742,923 A * 5/1988 Calvert ..... A47F 5/0823 211/57.1
4,773,172 A * 9/1988 Fast ..... A47F 5/0838 248/222.12
4,775,054 A * 10/1988 Dixon ..... A47F 5/08 211/57.1
4,865,205 A * 9/1989 Thorneburg ..... A47F 5/0815 211/59.1
4,934,080 A * 6/1990 Karnes ..... A47F 5/0869 40/642.01
4,936,565 A 6/1990 Fredrickson
4,976,058 A * 12/1990 Valiulis ..... A47F 5/0823 211/59.1
5,009,334 A * 4/1991 Bodkins ..... A47F 1/128 211/54.1
5,012,997 A * 5/1991 Hutchison ..... A47F 5/0869 211/59.1
5,042,669 A * 8/1991 Goldring ..... A47F 5/00 211/4
5,088,606 A * 2/1992 Boas ..... A47F 5/0869 211/57.1
5,233,773 A * 8/1993 Reynolds ..... G09F 3/18 248/289.31
5,257,702 A * 11/1993 Grafstein ..... A47F 5/0031 211/106
5,421,113 A * 6/1995 Gebka ..... A47F 5/0869 40/642.01
5,470,138 A * 11/1995 Kump ..... A47F 1/12 206/39.5
5,671,851 A * 9/1997 Johnson ..... A47F 1/128 211/106
5,678,794 A * 10/1997 Kump ..... A47F 5/0869 211/59.1
5,855,282 A * 1/1999 Hardy ..... A47F 5/0823 211/106
6,079,574 A * 6/2000 Mylander ..... A47F 5/0087 211/106
6,128,843 A * 10/2000 Gebka ..... A47F 5/0869 211/57.1
6,189,247 B1 * 2/2001 Gebka ..... A47F 5/0869 40/642.01
6,412,204 B1 * 7/2002 Shoemaker ..... G09F 7/18 248/289.31
6,643,900 B2 * 11/2003 Jahrling ..... A47B 55/02 24/336
6,694,654 B2 * 2/2004 Poulokefalos ..... A47F 5/0823 40/642.01
7,278,231 B2 * 10/2007 Lowry ..... G09F 3/204 206/462
7,513,074 B2 * 4/2009 Glenn ..... A47F 5/0823 24/654
7,533,784 B2 * 5/2009 Vlastakis ..... A47F 5/0861 221/151
7,566,037 B2 * 7/2009 Vogler ..... A47F 1/128 211/54.1
8,240,486 B2 * 8/2012 Niederhuefner ..... A47F 1/128 211/51
8,439,208 B2 * 5/2013 Niederhuefner ..... A47F 1/128 211/51
8,667,720 B2 * 3/2014 Hawkins ..... B23P 17/04 211/59.4
8,827,089 B2 * 9/2014 Stukenberg ..... A47F 5/0815 211/103
9,247,833 B2 * 2/2016 Pena ..... A47F 5/0861
9,456,708 B2 * 10/2016 Theisen ..... A47F 5/0823
10,016,070 B1 * 7/2018 DeSena ..... A47F 1/128
2003/0111433 A1 * 6/2003 Park ..... A47F 5/0807 211/59.1
2008/0203253 A1 * 8/2008 Vogler ..... A47F 1/128 248/220.31
2010/0044326 A1 * 2/2010 Meyer-Hanover .... A47F 5/0025 211/59.4
2011/0068067 A1 * 3/2011 Foltz ..... A47F 5/0006 211/59.2
2011/0215061 A1 * 9/2011 Niederhuefner ..... A47F 1/128 211/59.3
2013/0298376 A1 * 11/2013 Hawkins ..... B23P 17/04 29/428
2014/0091051 A1 4/2014 Battilana

* cited by examiner

PROMOTION DEVICE

FIELD OF THE INVENTION

The invention relates to a promotion device for communicating information regarding a product on display on a hook, rod or shelf that is for instance part of a store fixture shelving system, a pegboard or slatwall system or display system for retail.

BACKGROUND OF THE INVENTION

In the art, many different types of additional devices that can be added onto a hook or rod for a product display stand are known. The hooks can for instance be part of a slat wall or peg wall.

WO00/28512 for instance according to its abstract describes a label holder which is intended to be mounted in front of the outer end of a rod that projects out from a product display stand or corresponding structure. The rod includes means which enables the holder to be pivotally mounted to the rod so that the holder can swing vertically. The rear side of the holder includes a number of support surfaces. The surfaces are located at mutually different distances from the rear surface of the holder and can be caused to coact selectively with the end surface of the rod or with a rod-mounted means so as to enable the holder to be adjusted to different angles relative to the rod.

U.S. Pat. No. 4,531,313 according to its abstract describes a product identification tag that is fabricated from plastic and, in one embodiment, snap-fits onto a support member for a peg board hook without requiring removal of the hook from the peg board or the displayed merchandise from the hook. Support structure on the tag includes two holes spaced to correspond to the spacing between two legs in the hooked support member which are insertable into two peg board holes, respectively. Access channels are cut from a nearby mounting edge of the tag to the holes to permit the legs to be inserted into the respective holes only when portions of the tag which bound the access channels are flexed. In a second embodiment, using the same or a different form of tag mounting structure, the tag is secured adjacent a support wall, behind supported merchandise items, and projects forwardly alongside the supported merchandise items before terminating in a display section which is folded or bent to be disposed forwardly of the suspended merchandise FR1589683 according to its abstract describes a removable support for a display bearing a slide that can be inserted into the edges of a profile usually intended to receive price platelets. The support carries one or more openings enabling it to engage rods supporting the display itself. The removable displays are suitable for the item to be displayed.

U.S. Pat. No. 6,321,475 according to its abstract describes a display device for mounting to the front edge of a store shelf that provides a sealed environment for display of an object. Preferably, the object is in a constructed craft item which may be assembled from a kit which is offered for sale and is located on the store shelf adjacent the display device. The displayed object serves as a promotional vehicle for the kit. The display device includes a bracket for mounting the display device to the shelf and a product display case mounted to the bracket. The product display case includes a shelf construction upon which the constructed object can be displayed and a protective dome surrounding the shelf construction. The shelf construction may have a friction fit with the protective dome and can include a forward wall adapted to support the object to be displayed.

GB2340736 according to its abstract describes a support bracket that includes a tongue upon which goods are hung, a downwardly depending location and locking member with recesses, and a clip for engagement with a selected recess. The member is intended to pass behind and be supported by a front edge strip of a shelf, the clip then locking the member in place. A rectangular guard rail may surround the tongue.

The EP1922959 family member of DE202006017549 according to its abstract describes a product holder that has a support arm for products and an extension arm that overlaps the support arm and a plate is arranged at its end as information carrier. The plate has such a height extension that it overlaps the support arm downward from the horizontal front. The height extension is larger than the width of the plate. A wall holder is provided to fasten the support arm at a wall.

SUMMARY OF THE INVENTION

The invention provides additional and/or alternative device for communicating information regarding products that are on display for instance on a rod or hook or shelf of a display stand or similar structure. Furthermore of alternatively, such a device is relatively easy and/or economic to produce and/or to apply.

The invention pertains to a promotion device for communicating information regarding a product on display on a display system for retail and attached to a hook or rod that is part of a store fixture shelving system, a pegboard or slatwall system, or display system for retail, said device comprising a mounting part for attaching to a rod of said retail display system, an arm extending from said mounting part to an end of said rod, and a frame attached to an end of said arm and for said frame providing a cadre around the product.

The promotion device provides a relatively simple to use and cadre around a product for attracting attention to that product. The promotion device can highlight a product or series of products, or it can draw extra attention. In this respect, "around a product" relates to an angle of view of a consumer looking at the product while on display. When looking at the product, the consumer sees a cadre around the product, and sees the product through the cadre.

In this respect, a hook or rod relates to types of rods or hooks are generally used on a display stand or display wall that are commonly used in stores or other points of sale, like for instance supermarkets, do it yourself stores, fashion stores, convenience stores, tank stations, or any other retail store. Hooks or rods are often available on slatwalls, hanging mesh bars and pegboards. These hooks generally allow multiple examples or items of a product to be provided on a hook, one product behind the other. The hook can be a single rod or bar that extends, or multiple bars. For instance, it may be a "Euro hook", a "single prong hook", or another type of hook attached to a backwall. These arms can have various lengths. In an embodiment, the promotion device is attached to a hook that comprises one or more substantially parallel bars extending in a longitudinal direction. The promotion device in use comprises an arm extending substantially parallel to that longitudinal direction. In an embodiment, the promotion device arm extends at a distance from the hook in order to allow easy removal or not hinder removal of a product from the hook. In an embodiment, the arm is a straight arm.

Alternatively or in combination, the display system may comprise shelfs on which a product can he placed. These shelfs may for instance comprise a grating of bars, for instance a series of bars extending from the display, and mutually coupled to form a shelf, for instance by two of more elongated cross bars.

The promotion device holds a frame that in use provides a cadre or rim or framing or frame work around the product. It thus draws additional attention to a product of series of products on one hook. In an embodiment, the frame leaves sufficient room to allow removal of a product from a hook.

In an embodiment, a length of said arm is extendable. Thus, the promotion device can be used on different types of hooks. In an embodiment, the arm is telescopic. In an embodiment, different lengths of arms can be provided and that are attachable at one end to a mounting part and at its opposite end to the frame.

In an embodiment, a size of said frame is adjustable. In an embodiment, the frame comprises corner parts and frame parts, detachably coupled to provide said frame. The corner parts and frame parts may comprise various snap-positions for attaching the parts together, thus allowing various sizes of frame. Alternatively, frame parts of various lengths may be provided so a user can select suitable frame part to assemble a frame with a desired frame size.

In an embodiment, the mounting part has a hole for receiving one end of the arm. Alternatively, the mounting part and arm are formed in one piece. The mounting part comprises a clamping part for attaching to the hook of rod.

In an embodiment, the mounting part comprises two parts that are snapped together, holding the hook of rod between them.

In an embodiment, the arm comprises a frame attachment part at an end, allowing connecting said arm to said frame, in particular with a longitudinal axis of said arm substantially perpendicularly to said frame.

In an embodiment, wherein for said display system in which said rod is part of a shelf comprising a series of rods, said mounting part is adapted for attaching to one or more rods of said shelf, in particular said mounting part comprises opposite parts that can be forced toward one another and that are adapted to be clamped between parallel bars.

In an embodiment, wherein for said display system which comprises a shelf on which said product is displayed and a further shelf, said mounting part is provided for attaching to said further shelf of said display system, and said arm extending from said mounting part to provided said cadre around said product.

In an embodiment, said shelves comprise a mounting side and an opposite, free side, said arm extending to a said free side.

In an embodiment, said device comprises a series of mounting parts and arms, said arms attaching to said frame and extending substantially parallel.

The invention further pertains to a kit-of-parts providing said promotion device when assembled, said kit-of-parts comprising said mounting part, said arm, and corner parts and frame parts for forming said frame. In particular said kit-of-part comprises a series of said frame parts of various lengths.

The invention further pertains to a kit of parts comprising corner parts and frame parts for forming a frame for the promotion device. For instance, as explained, different lengths of frame parts can be provided. Alternatively of in combination, as also already explained, different lengths of arm parts can be provided. Furthermore or alternatively, various mounting parts can be provided to allows attachment of the promotion device to various types of hooks.

The invention further pertains to promotion device for communicating information regarding a product on display on a display system for retail, for instance attached to a hook or rod that is for instance part of a store fixture shelving system, a pegboard or slatwall system, or display system for retail, said device comprising a mounting part for attaching to said retail display system, an arm extending from said mounting part, and a frame attached to an end of said arm and providing a cadre around the product.

The invention further pertains to promotion device for communicating information regarding a product on display on a display system for retail, for instance attached to a hook or rod that is for instance part of a store fixture shelving system, a pegboard or slatwall system, or display system for retail, said device comprising a mounting part for attaching to said retail display system, and a frame attached to said mounting part and for providing said frame as a cadre around the product.

The person skilled in the art will understand the term "substantially" in this application, such as in "substantially encloses" or in "substantially extends up to". The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like if used in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The promotion device herein is amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device or apparatus claims enumerating several means, several of these means may be embodied by one and the same item of hardware. The mere fact that certain measures are recited in mutually different dependent claims does not indicate that a combination of these measures cannot be used to advantage.

The invention further applies to a promotion device or parts thereof comprising one or more of the characterising features described in the description and/or shown in the attached drawings. The invention further pertains to a method or process comprising one or more of the characterising features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of a promotion device will now be described, by way of example only, with reference to the accompanying schematic drawings in which corresponding reference symbols indicate corresponding parts, showing an embodiment of a promotion device, and showing in.

The drawings are not necessarily on scale.

DESCRIPTION OF PREFERRED EMBODIMENTS

Figure 1:
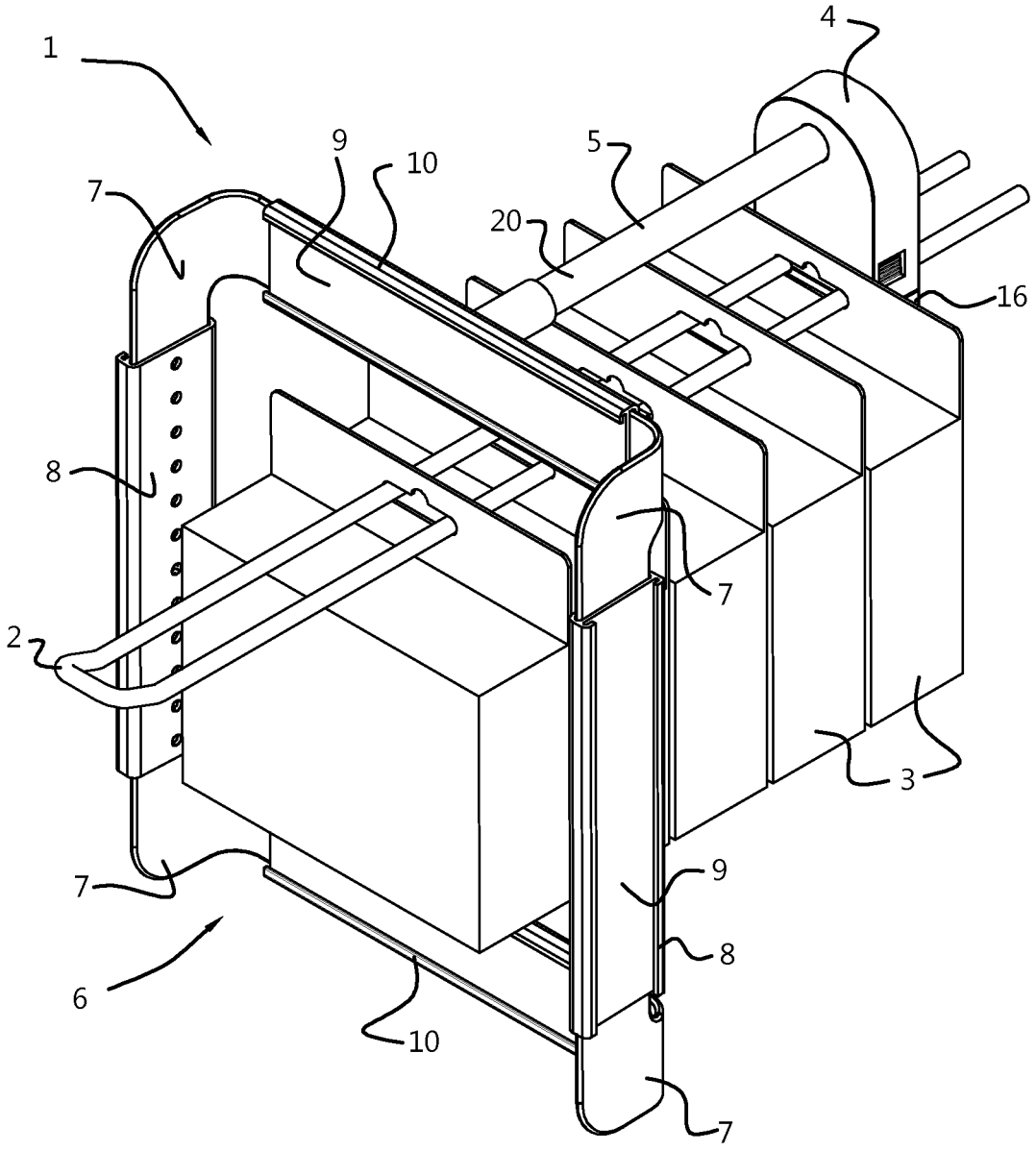
FIG. 1 a perspective view on a promotion device from the front.
Figure 2:
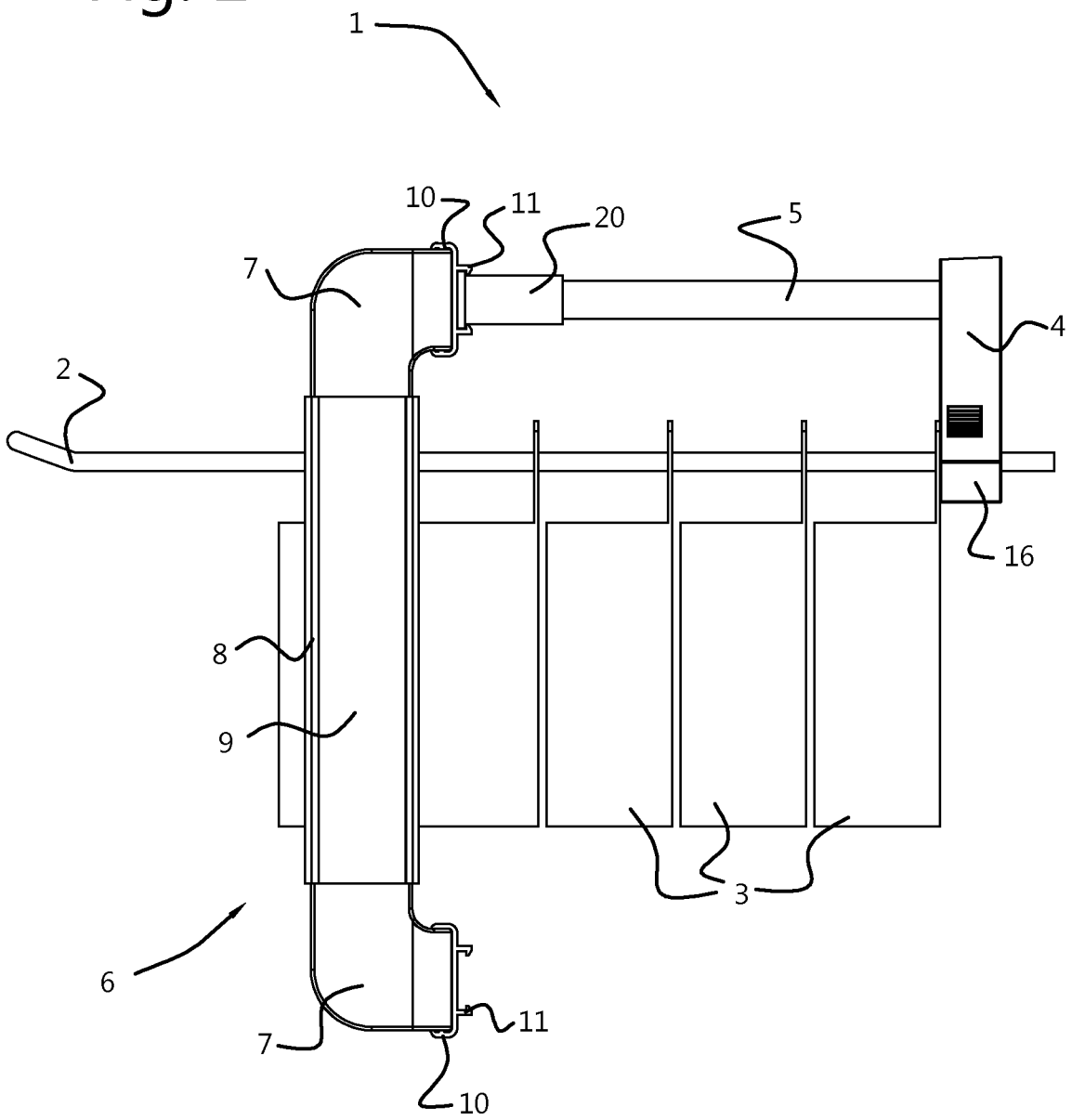
FIG. 2 a side view on the promotion device of FIG. 1.

FIG. 1 shows a perspective view on a promotion device 1. The promotion device 1 is attached or clipped onto a hook or rod 2. These types of rods or hooks are generally used on a display stand of display wall that are commonly used in stores or other points of sale, like for instance convenience stores, tank stations, supermarkets, do it yourself stores, fashion stores, convenience stores, tank stations, or and any other retail store. The rods or hook 2 is provided with products 3, which are usually provided with a hole or other provisions that allows the products 3 to be attached to the hook or rod. Usually, a series of products 3 are provided on one hook or rod 2, and often these series of products 3 are provided in a row, one behind the other. Thus, a customer can take a specimen of the product 3 from the hook or rod 2. Then for a next customer a specimen of the product remains. In some instances, the series of products 3 may be biased towards the end of the hook or rod 2. Usually, a display or display wall is provided with a series of these hooks or rods 2. Thus, several rows of hooks or rods can be provided. Each of these hooks or rods 2 may be provided with identical products 3, different products 3, or for instance another embodiment of the same product, like for instance chargeable and non-chargeable batteries.

Figure 3:
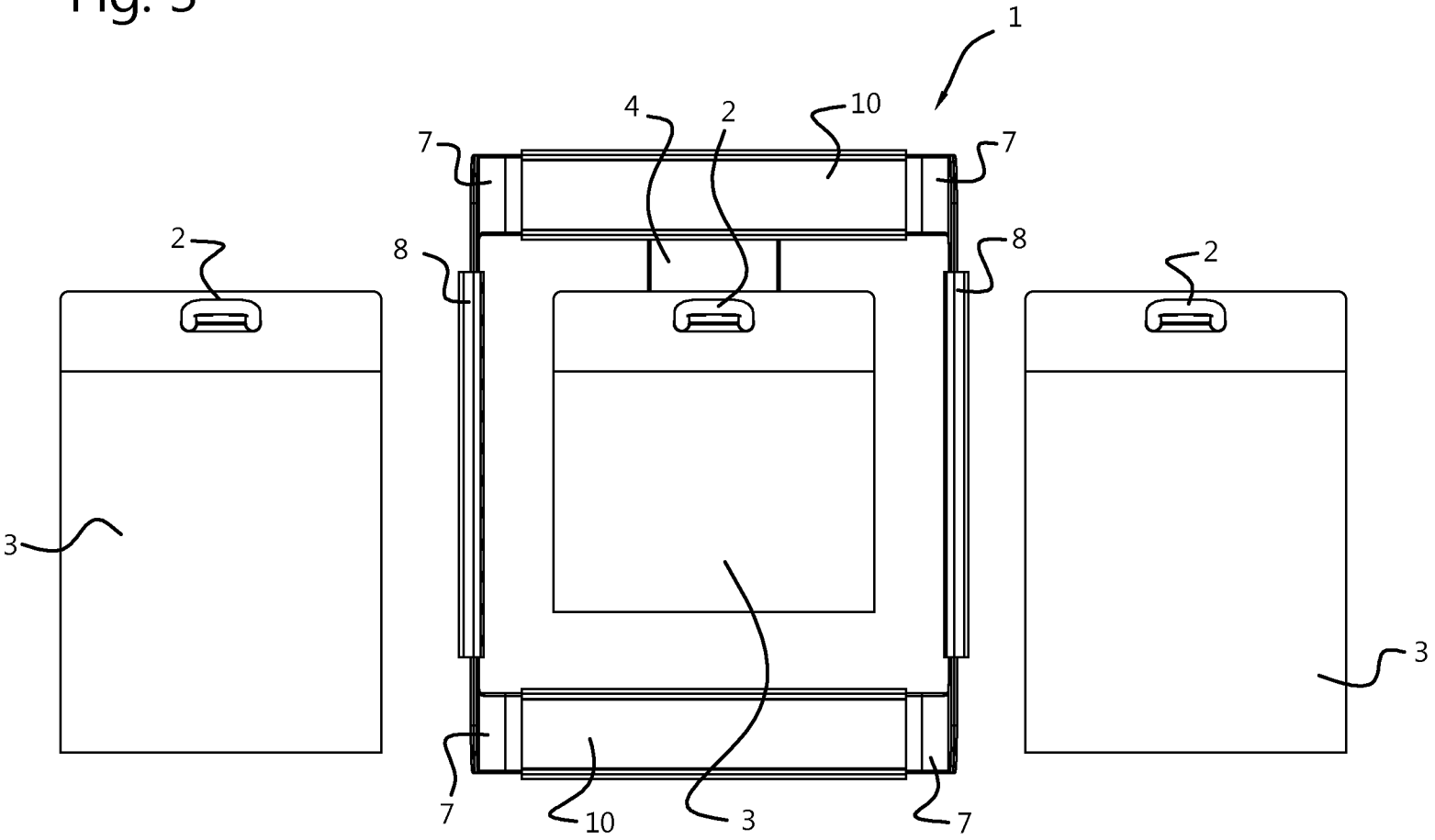
FIG. 3, a frontal view on the promotion device of FIG. 1, with an each side an additional hook or rod with products on a display stand.

The promotion device provides a frame 6 that provides a cadre around a product or series of products 3 on one hook or rod 2. The drawings 1, 2, 3 and 5 illustrate this. As FIG. 3 most clearly illustrates, the promotion device 1 thus provides via the frame 6 additional attention on, or additional information regarding, products 3 on one of the hooks or rods 2 on a display wall or display stand.

The promotion device 1 comprises a mounting part 4 that allows the promotion device to be attached to the hook of rod 2. The mounting part 4 can be adapted to the particular hook or rod 2. In the current example, the hook or rod 2 in fact comprises a bar that is bent twice at a part to provide a hook end, and the two ends of the hook or rod 2 extend parallel to one another to provide in fact two parallel bars. Such a hook 2 is universally used in stores or points of sale, with the ends of the bars, providing a hook attachment end, inserted into a peg board (not illustrated). The mounting part 4 is here attached near the hook attachment end of the hook 2. In fact, in most situations the mounting part 4 will be attached between the last product of a series of products 3 on a hook 2 and near the hook attachment end. Usually, the mounting part 4 will be clipped onto a hook. A snap coupling may he used that is adapted to a specific embodiment of the hook 2. Alternatively, a snap coupling my be provided that fits or snaps onto various different types of hooks or rods 2. Alternatively, sets of mounting parts may be provides, each for specific, general types of hooks or rods known in the business of product displays.

Attached to the mounting part 4 is an arm 5 that here extends substantially parallel to the hook or rod 2. In general, the arm extends towards the hook end of the hook or rod 2. Here, the arm comprises a rod, with one end attached to the mounting part 4 and its opposite end attached to the frame 6. Thus, the arm 5 holds the frame 6 at or near the hook end. The frame 6 is held in such a way that it provides a frame around a product 3. Here, the frame 6 is rectangular, though for products that are shaped differently, another shape of frame may be customised, like for instance round, triangular, or polygonal.

The frame may be a frame of fixed size formed in one piece. The frame 6 here is compose of four corner ends 7 connecting four frame parts 8, 10.

In the embodiment shown in the drawings, the frame 6 provides several label holding parts 9. Here, the frame parts 8, 10 each comprise a label holding part 9, and the label holding parts extend over the length of the frame parts 8, 10. In the label holding parts 9, simple labels may be places that provide for instance promotional information, These labels may also comprise electronic display devices. Due to the specific embodiment of the corner parts 7, with bends in two orthogonal directions, providing a double bend, the label holding parts are here normal or perpendicular with respect to one another. More in particular, frame parts 10 are in a plane substantially normal to an extending direction of hook or rod 2. Frame parts 8 are substantially parallel to that extension direction of the hook or rod 2. In this way, information can be provided to customers that are in front of a display with hooks, as well as to customers that are not directly in front of a display. The corner parts 7 of this example have one bent that is in a plane, and on of the legs is bent out of that plane.

The various parts of the promotion device may be made from plastic, for instance thermoplastic or a setting plastic. In an embodiment, one or more of the parts is produced using injection moulding, although combinations of injection moulding, extrusion and/or 3D printing may be used in preparing one or more of the parts of the promotion device 1. For instance, the frame parts 8, 10 may be produced using extrusion. The rod of arm 5 may also be produced using extrusion. In that way, for instance the lengths of the frame parts 8, 10 may be varied easily.

The mounting part 4, on the other hand, may be produced using 3D printing for instance, making it easier to adapt it for attachment to another type or shape of hook or rod 2.

Figure 4:
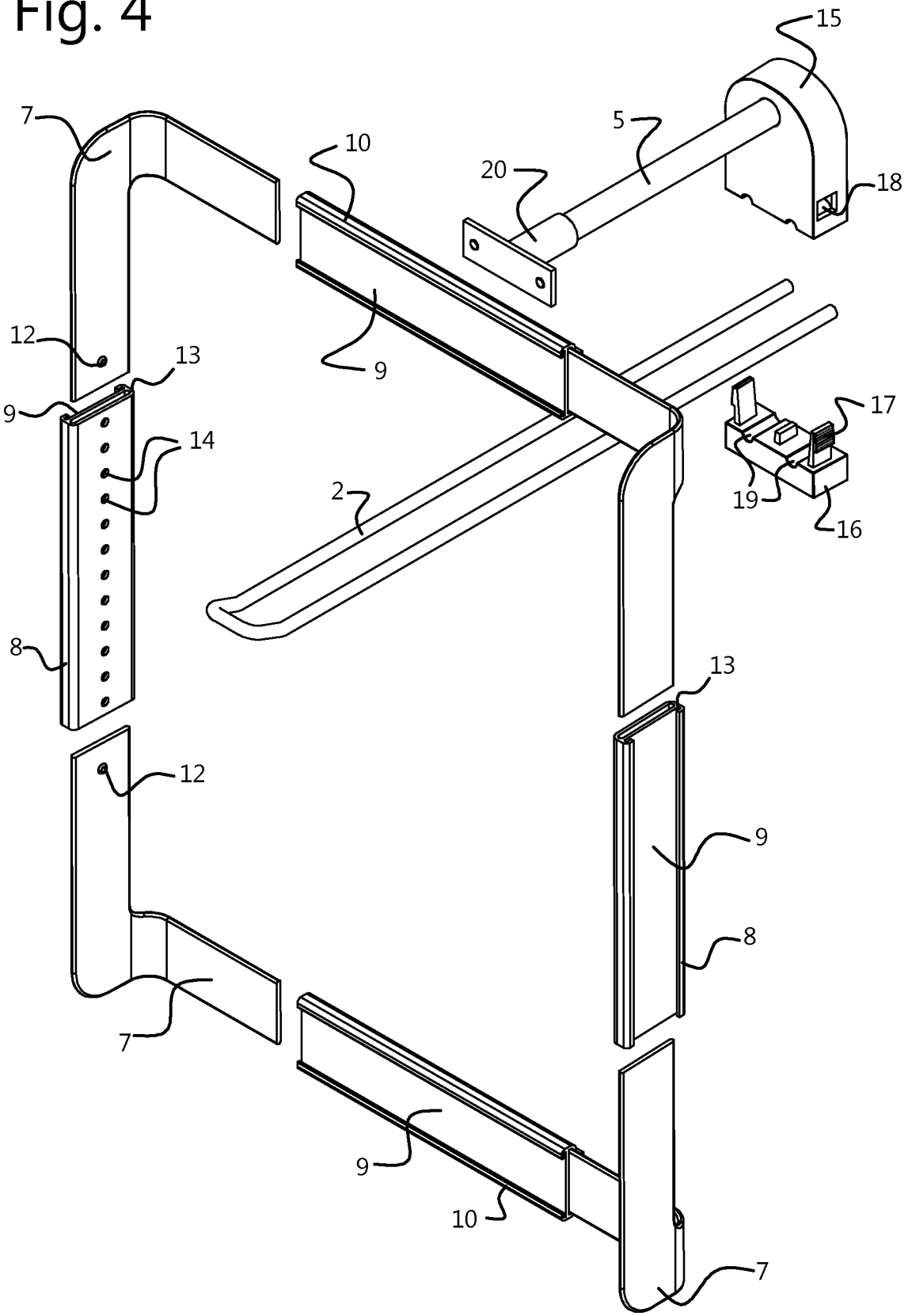
FIG. 4 an exploded view of the promotion device of FIG. 1.
Figure 5:
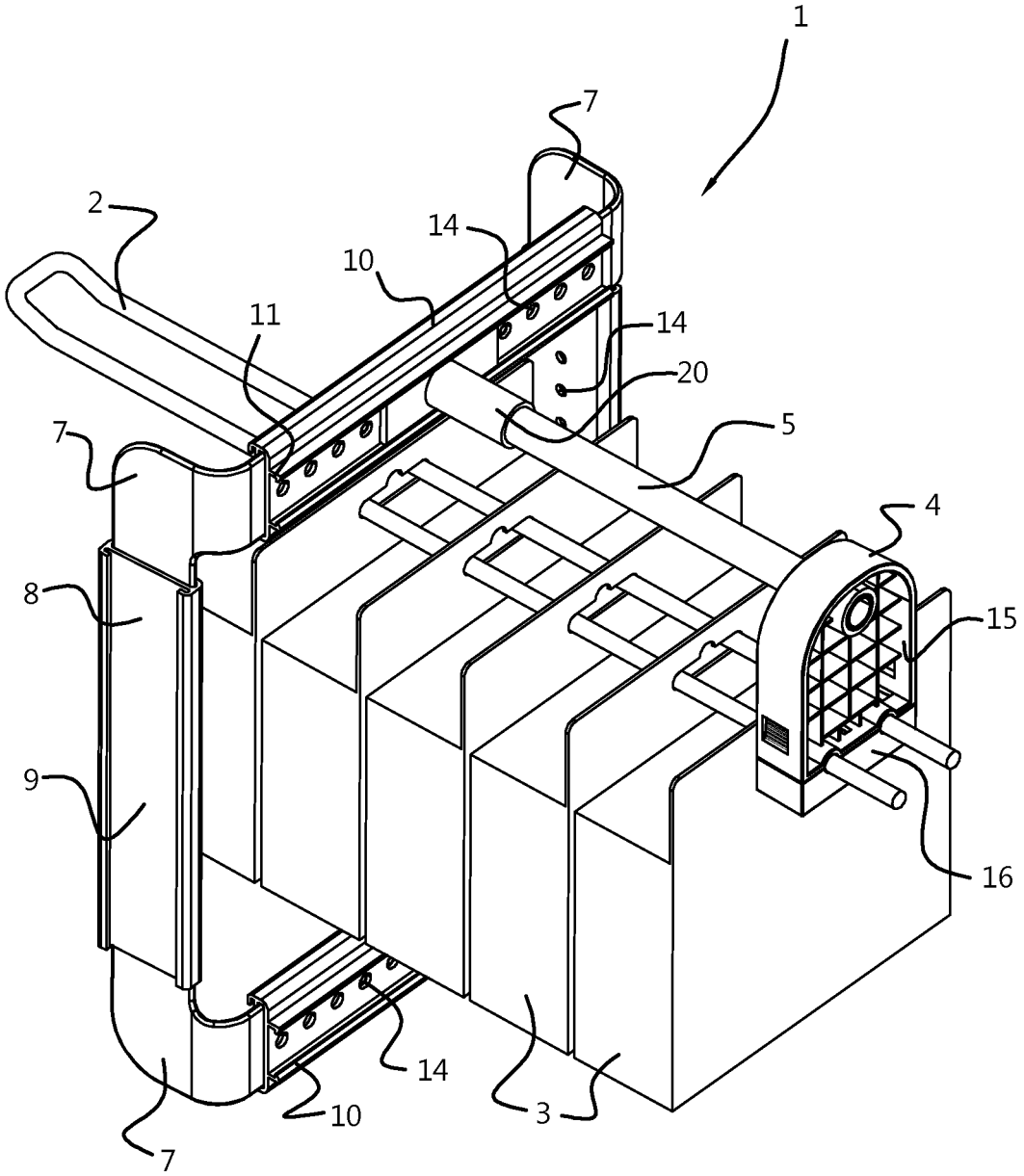
FIG. 5 a perspective view on the promotion device of FIG. 1 from the rear.
Figure 6:
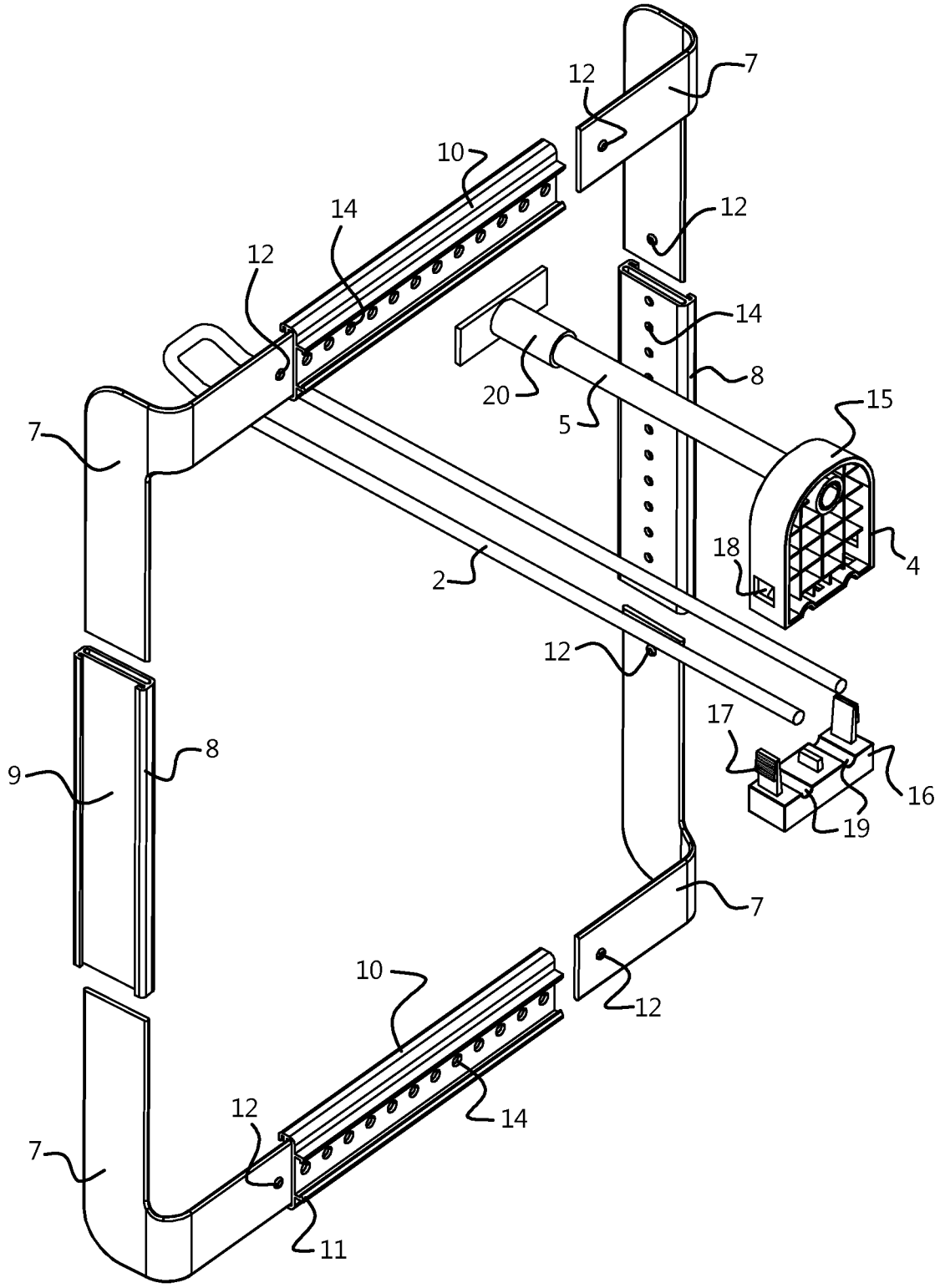
FIG. 6 an exploded view on the rear on the promotion device of FIG. 1.
Figure 7:
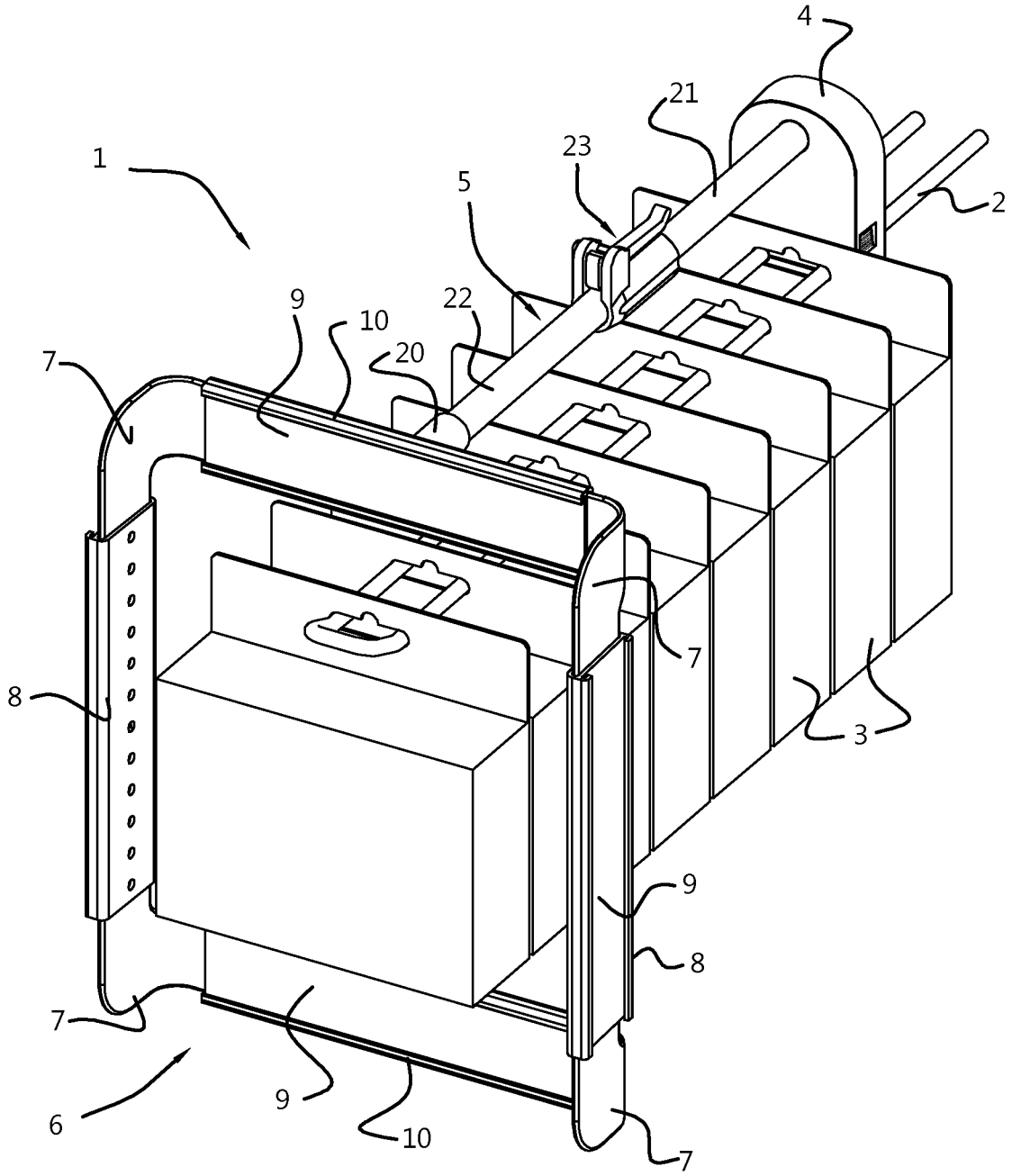
FIG. 7 a perspective view of the promotion device of FIG. 1, with extendable arm, FIG. 8 a promotion device with an alternative mounting part in perspective view, FIG. 9 the promotion device of FIG. 8 showing a step of attaching the mounting part on a hook.
Figure 8:
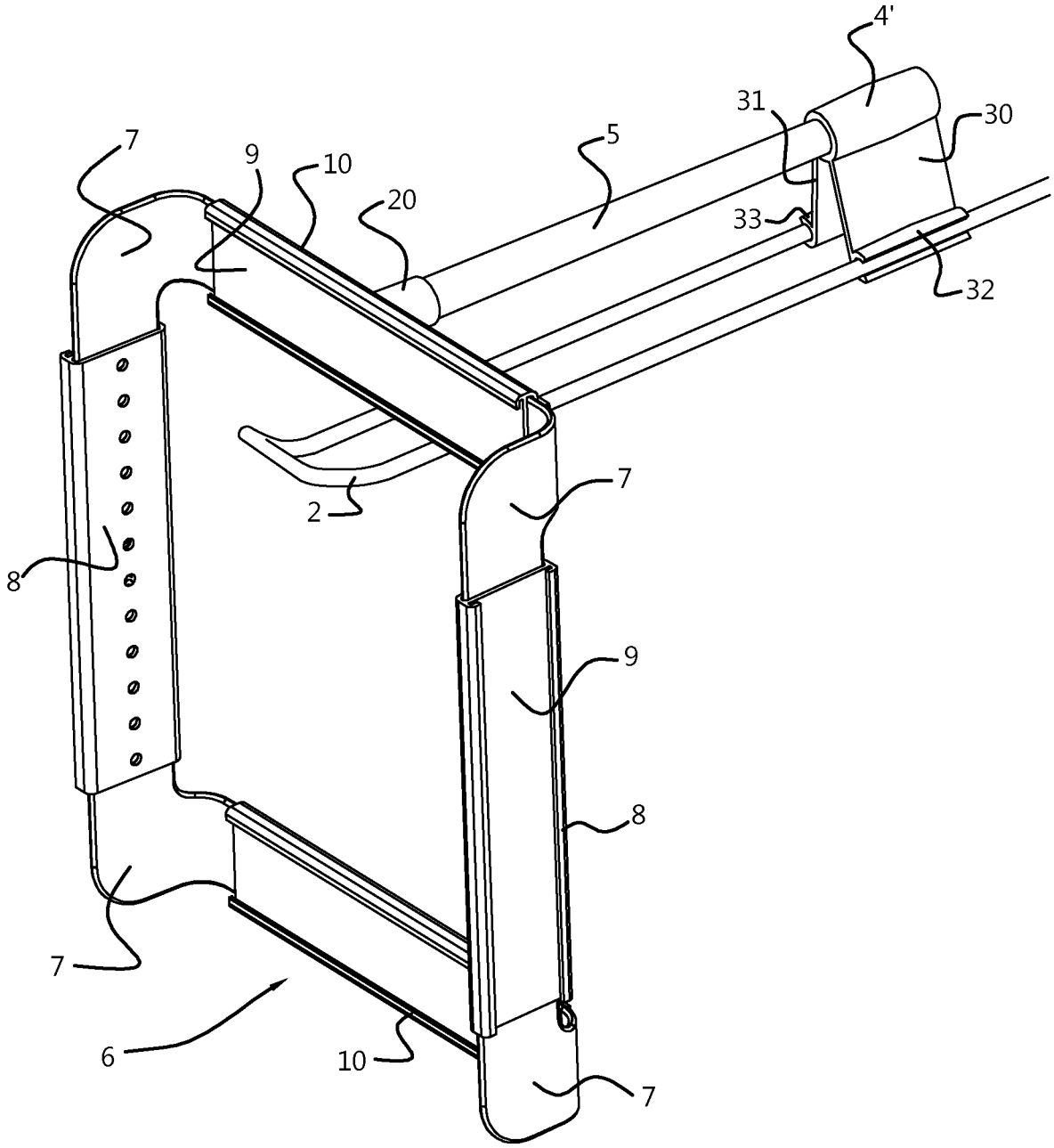

As can be seen perhaps the clearest in FIGS. 4-6, are 5 in the example comprises a tube element that fits in an opening in mounting part 4. Furthermore, here the frame attachment part 20 comprises a sleeve end in which the tube element is fitted. This construction may of course be reversed, for instance the attachment part 20 comprising a rod end fitting inside the tube element. Other attachment constructions or combinations are possible. In an embodiment, arm 5 may be telescopic, allowing the arm to be extended or reduced in length when required. Alternatively, different arm elements of various lengths may be provided. In FIG. 7, an example is shown of a promotion device with a telescopic arm. Here, the arm 5 comprises two telescopic arm parts 21, 22. These telescopic arm parts are here two tubes, one fitting in the other. In order to fix a length of the arm 5, an arm-locking part is provided. In this embodiment, an eccentric lever is provided that is fixed to arm part 21. In the current position, it locks the other arm part 22 from moving. When the lever is pulled up, the other arm part 22 is freed and can slide into the arm part 22. In this way, the length or arm 5 can be adjusted, for instance to the In this example, the frame attachment part 20 comprises a plate-shaped part that fits into a rail 11 that can for instance be seen in FIG. 6, The plate-shaped part has here two extensions (FIG. 4) that snap into recesses 14. Other constructions for attaching the arm to the frame may be possible, although the selected construction is both simple and stable.

The frame parts 8, 10 may have various lengths, allowing to set the size of the frame. The length of frame parts 8 may also differ from the length of frame parts 10, making the frame rectangular but non-square.

In order to connect the corner parts 7 to the frame parts 8, 10, the ends of the corner parts in this example are flat and rectangularly plate-shaped, and the frame parts 8, 10 have rectangular cavities 13 at both ends that can fit the corner part ends. Here, the corner part ends comprise an extension 12 that snaps in hole 14 provided in wall of frame part 8, 10. Again, other constructions for connecting corner parts 7 and frame parts 8, 10, the simplest being a reversal of the illustrated construction. The different parts of the frame may for instance have a more rectangular or for instance a round cross section.

FIGS. 4, 6 show an embodiment of the mounting part 4 in more detail, in an exploded view. Here is an upper part 15 and a lower part 16 that clamp the hook or rod 2 between them. The upper and lower parts can be snapped together, although parts may also be connected, for instance via a (living) hinge to make attachment more easy and avoid one smaller part from getting lost.

Here, the lower part is provided with snap-lips 17 that are inserted into the upper part 15 and snap into holes 18.

The upper part 15 and the lower part 16 of the mounting part 4 are provided with grooves 19 that can fit the bars of hook or rod 2. Here, the two parts have corresponding grooves that together fit the bars. It may fit tightly, in an embodiment it is adapted to fit tightly but allows the sliding back and forth, for instance for keeping the frame framing the front product of products 3 (see e.g., FIG. 5). Alternatively or additionally, the upper part 15 and lower part 16 may be coupled at one side via a hinge, for instance a living hinge. The two parts of this mounting part 4' hold the rods of a hook 2 clamped.

In FIGS. 8-11, a promotion device with an alternative mounting part 4' is presented. This mounting part 4' is designed to clamp itself between parts of a hook 2. Here, the mounting part 4' clamps itself between two bars of a hook 2. To that end, the mounting part 4' here has two wing 30 and 31. These wings 30, 31 are designed to be able to flex towards one another. At their respective ends, the wings 30, 31 are provided with respective snap parts 32, 33 that are adapted to snap around rods of the hook 2. Here, the snap parts 32, 33 open sideways, i.e., in a direction perpendicular with respect to the longitudinal direction of the arm 5. Here, the mounting part 3 has a sleeve that slides over an end of the arm 5. The mounting part allows the promotion device to be mounted not only on a hook 2, but also on a display shelf made of parallel bars, as demonstrated in FIG. 11. Here, the promotion device in fact hangs on one shelf 2' and draws attention to a product 3' on a lower shelf 2'

Figure 9:
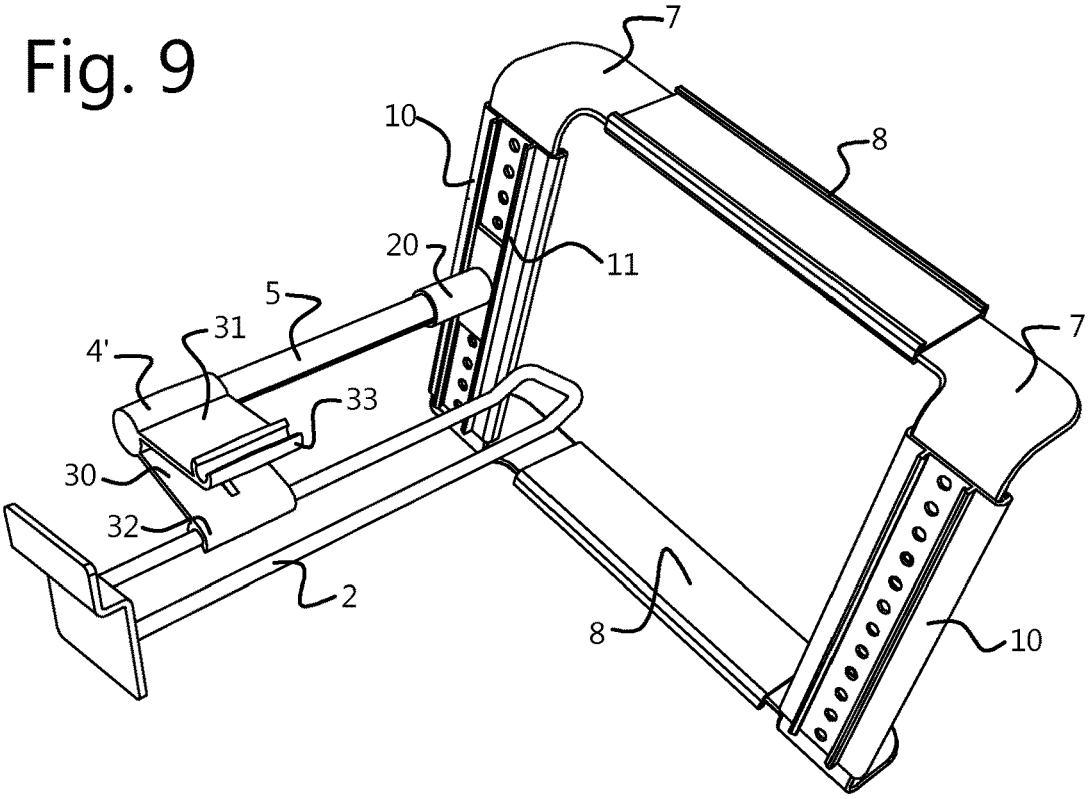
Figure 10:
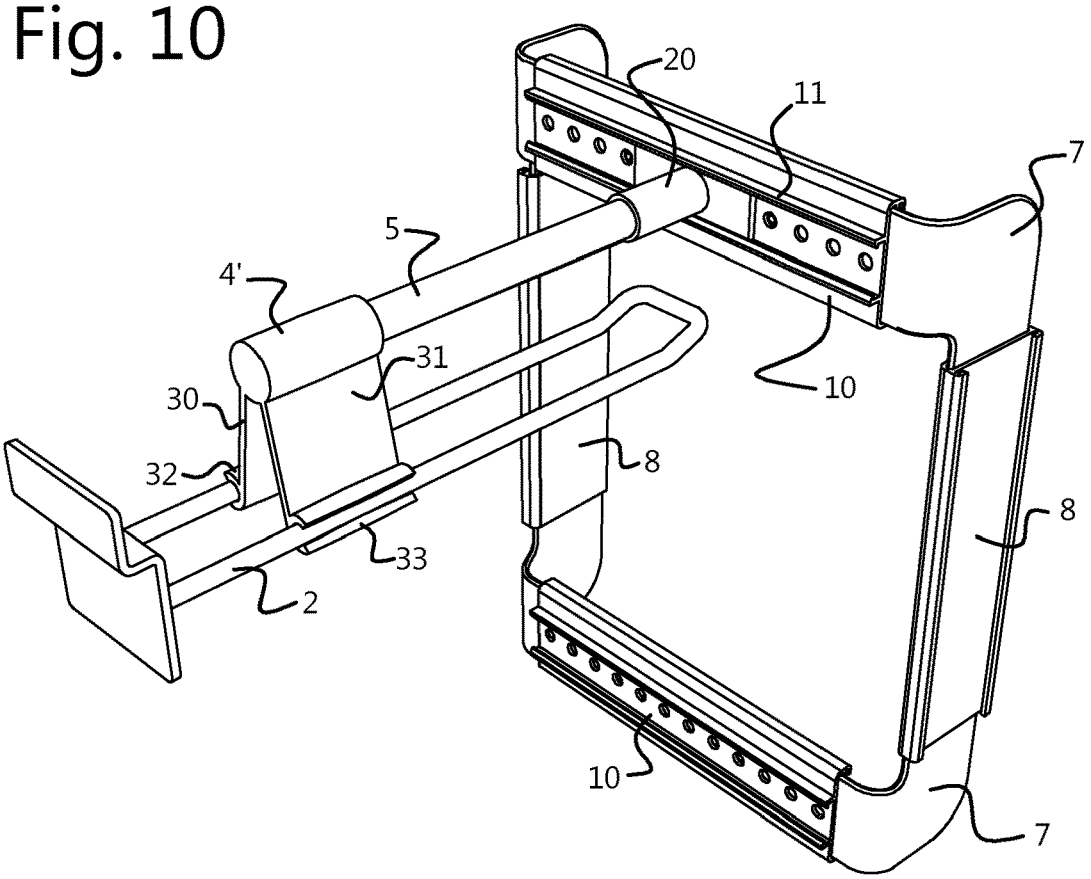
FIG. 10 the promotion device of FIG. 8 in perspective view from the rear.

In FIG. 9, a first step of mounting the promotion device on a hook 2 with two parallel bars is demonstrated. First, the promotion device is rotated about the direction of the arm 5 to allow one snap part 32 to be snapped onto a bar of hook 2. Next, the promotion device is rotated in opposite direction while the wings 30, 31 are forced toward one another. When the snap part 33 of wing 31 is between the bars of hook 2, the pressure on the wings 30, 31 can be released. Thus the wings 30, 31 will return in their unbiased position. Their ends will move away from one another and the snap part 33 will snap around the opposite bar of hook 2. Now, the mounting part 4' has its two snap parts on the bars of hook 2 and the wings 30, 31 may have some remaining biasing force urging the wings 30, 31 apart and thus urging the snap parts 32, 33 on the bars.

Figure 11:
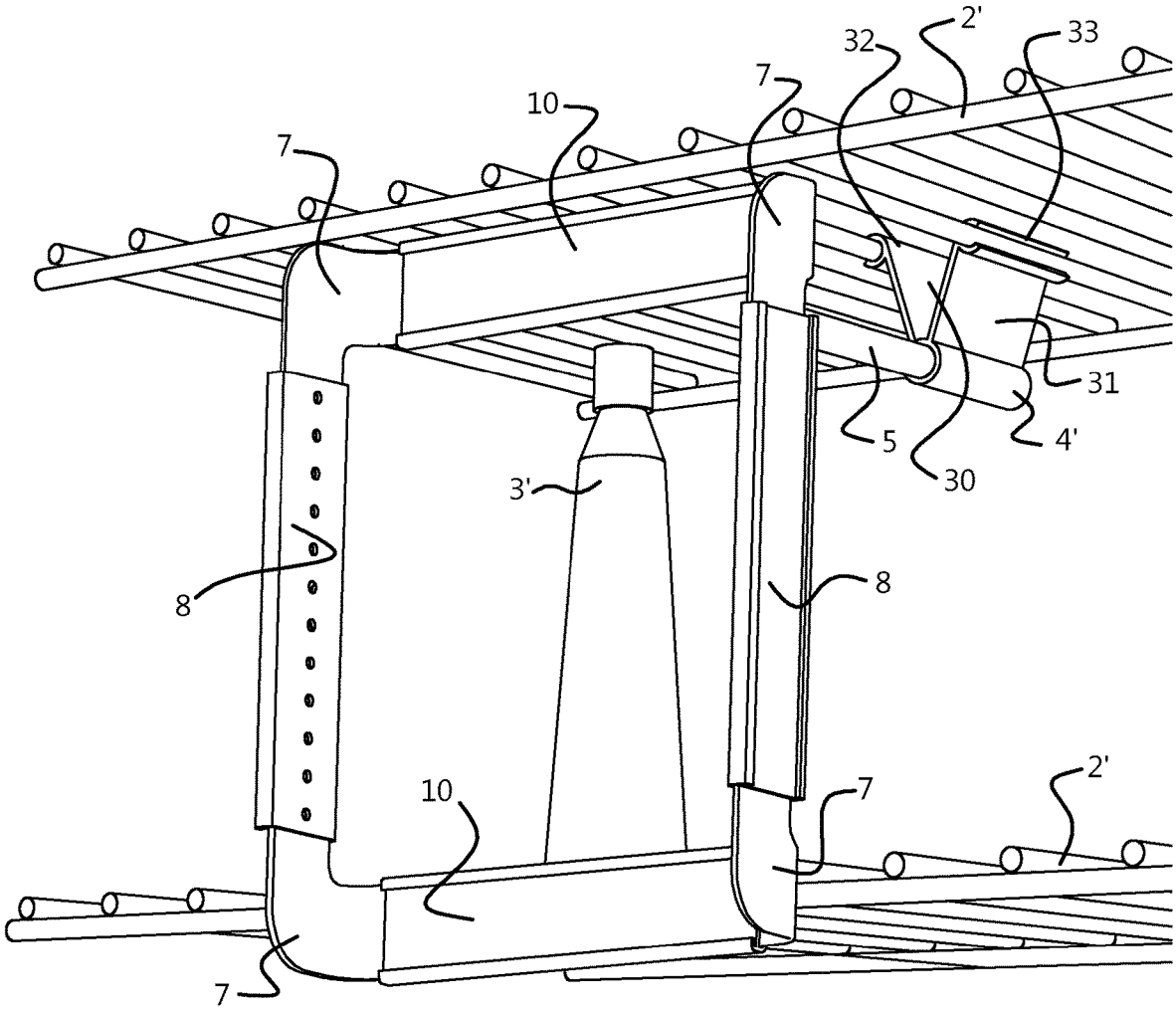
FIG. 11 the promotion device of FIG. 8 mounted on a display shelf with bars, and FIG. 12 a promotion device mounted under a display shelf with bars.

In FIG. 11, already briefly mentioned earlier, in fact an alternative positioning of the promotion device is demonstrated. Here, the product is held by an element of the display system. And the promotion device is attached to another part of the display system. The product is here places on a lower shelf 2', while the promotion device is mounted on a higher shelf 2'. The shelf 2' here has parallel extending bars. Here these parallel extending bars are coupled by two or more cross bars, here a cross bar near the ends of the extending bars. The mounting part 4' clamps itself between two parallel extending bars.

FIG. 11 shows a promotion device 1 that can mounted under a display shelf and that has a frame that provides a cadre for a product on a lower shelf. In FIG. 11, the promotion device is mounted under a display shelf with bars. In an embodiment shown in FIG. 12 and which largely resembles the embodiment of FIG. 11, the frame 6 is enlarged in order to provide a cadre for several products. The frame 6 has the same corner parts 7 and frame parts 8, 10. The (upper and lower) frame parts 10 are longer that in FIG. 11. Frame parts 10, 8 can be provided in different lengths to provide various frame sizes. Alternatively, the length of frame parts 8, 10 may be adjustable. Frame parts 8, 10 can for instance be provided with break lines or can be sawn to length.

Figure 12:
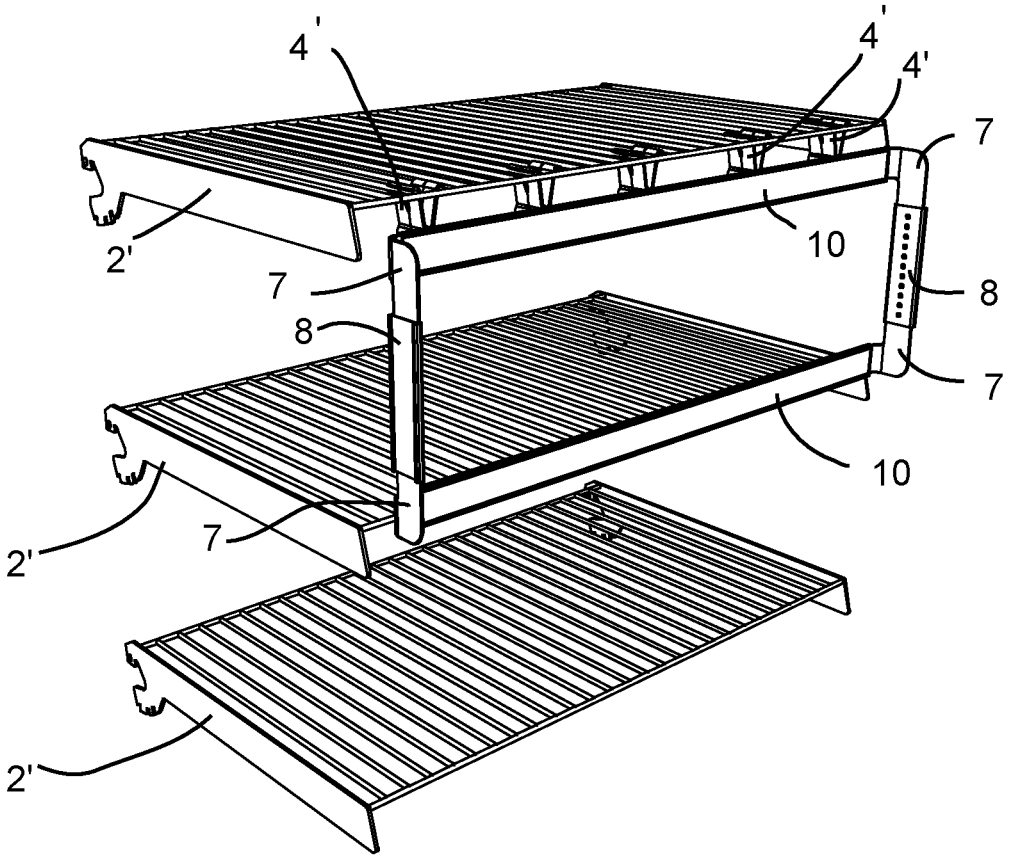

As a support for this enlarged frame of FIG. 12, several parallel arms and mounting parts 4' can be provided for holding such an enlarged frame 6 in place. Alternatively or additionally, the frame 6 can also be attached in such a way that the frame 6 provides a cadre for products on the (here top) shelf on which the mounting parts 4' are attached. Additionally or alternatively, the frame 6 may even be attached to two shelves 2'. Thus, arms 5 are provided on the upper or top frame part 10 and on the lower frame part 10. Like FIG. 12, each arm has a mounting part 4'. This to provide a more secure attachment of the frame 6.

A promotion device 1 can be provided with an alternative mounting part. In an embodiment, the mounting part has permanent magnets incorporated, providing an example of such an alternative mounting part 4". In a display system with two or more shelves, for instance, or a shelf mounted above one or more hooks or rods, the alternative mounting part 4" can be attached to a shelf, for instance a lower surface of the shelf. The arm 5 then extends to an end of the shelf. In particular, the arm 5 extends parallel to the lower surface, in the same way as the embodiment shown in FIG. 11.

The arm can be provided with a joint for fine adjustment of the frame 6. The joint can for instance be provided on the mounting part 4 and can be provided with a receiving end for receiving and end of the arm 5. The joint can be a hinging joint allowing the frame to tilt for instance about a vertical of horizontal axis. Other joints like for instance a ball joint can also be used, allowing tilting in various directions. Joints can also be combined for providing additional degrees of tilting and adjusting.

It will also be clear that the above description and drawings are included to illustrate some embodiments of the invention, and not to limit the scope of protection. Starting from this disclosure, many more embodiments will be evident to a skilled person. These embodiments are within the scope of protection and the essence of this invention and are obvious combinations of prior art techniques and the disclosure of this patent.

REFERENCE NUMBERS

1 promotion device
2 rod or hook
3 product
4, 4' mounting part
5 arm
6 frame
7 corner part
8, 10 frame part
9 label holder
11 arm attachment part
12 extension
13 cavity
14 recess
15 first mounting part end
16 second mounting part end
17 snap lip
18 opening for snap lip
19 rod receiving provision
20 frame attachment part
21, 22 telescopic arm parts
23 arm locking part
30, 31 wings of mounting part
32, 33 snap parts

The invention claimed is:

1. A promotion device for communicating information regarding a row of products on display for retail, wherein the row of products on display is suspended from a hook or rod that is part of a display system, said device comprising:

a mounting part, wherein:

the mounting part is configured to be attached directly to the hook or rod from which the row of products is suspended, and the mounting part is further configured to be removably attachable to the hook or rod by hand, toollessly, an arm extending from said mounting part to a foremost product of the row of products suspended from said hook or rod, and a frame attached to an end of said arm, wherein:

the frame provides a cadre around the foremost product of the row of products suspended from said hook or rod, and the frame is configured to allow removal of said foremost product from said hook or rod through the frame, and the frame is attached only to the arm, the arm is otherwise attached only to the mounting part, and the mounting part is otherwise attached only to the hook or rod from which the row of products is suspended.

2. The device of claim 1, wherein a length of said arm is extendable.

3. The device of claim 1, wherein said arm is telescopic.

4. The device of claim 1, wherein a size of said frame is toollessly adjustable.

5. The device of claim 1, wherein said frame comprises corner parts and frame parts, detachably coupled to provide said frame.

6. The device of claim 1, wherein said mounting part comprises two separate parts that are snapped together, holding the hook or rod between them.

7. The device of claim 1, wherein said arm comprises a frame attachment part at an end, configured to connect said arm to said frame with a longitudinal axis of said arm substantially perpendicular to said frame.

8. The device of claim 1, wherein said mounting part comprises opposite parts that can be forced toward one another and that are adapted to be clamped around the hook or rod.

9. The device of claim 1, wherein said mounting part comprises two wings having ends extending away from said arm and adapted to be forced towards one another, said ends of the wings provided with a respective snap part opening in a direction opposite to the force.

10. The device of claim 9, wherein said wings are mounted at or under an angle.

11. The device of claim 9, wherein said wings can be forced together by hand force.

12. A kit-of-parts providing said promotion device of claim 1 when assembled, said kit-of-parts comprising said mounting part, said arm, and corner parts and frame parts for forming said frame, in particular said kit-of-part comprising a series of said frame parts of various lengths.

13. The device of claim 1, wherein said mounting part comprises opposite parts that can be forced toward one another and that are adapted to be clamped between parallel bars.

14. The device of claim 1, wherein the promotion device is configured to allow the foremost product suspended from the hook or rod to freely pass through the frame and off the hook or rod without any obstruction or interruption of a path of removal.

15. The device of claim 1, wherein the frame forms a complete cadre around the foremost product, such that a consumer looking at the foremost product while on display sees the cadre above, below, left, and right of the foremost product, and sees the foremost product through the cadre.

16. The device of claim 1, wherein the frame is not connected to any side support or side divider.

17. The device of claim 1, wherein the display system comprises a store fixture shelving system, a pegboard or slatwall system, a hanging mesh bar, or another display system for retail.

* * * * *